United States Patent [19]

Budny et al.

[11] Patent Number: 5,053,681

[45] Date of Patent: Oct. 1, 1991

[54] REMOTE ELECTRICAL CONVERTER

[75] Inventors: Bernard R. Budny, Milwaukee, Wis.; Robert G. Lockwood, 7303 Finevale Dr., Downey, Calif. 90240

[73] Assignee: Robert G. Lockwood, Paramount, Calif.

[21] Appl. No.: 339,219

[22] Filed: Apr. 17, 1989

[51] Int. Cl.[5] ..... H05B 41/36

[52] U.S. Cl. ..... 315/219; 315/220; 315/277; 315/279; 315/DIG. 5

[58] Field of Search ..... 315/219, 220, 221, 277, 315/278, 279, 272, 224, 315, 307, DIG. 2, DIG. 5, 324; 363/35, 37

[56] References Cited

U.S. PATENT DOCUMENTS

| | | | |
|---|---|---|---|
| 3,671,803 | 6/1972 | Hoxsie | 315/99 |
| 3,778,677 | 12/1973 | Kriege | 315/219 |
| 4,096,410 | 6/1978 | Alley | 315/86 |
| 4,129,805 | 12/1978 | Sherman | 315/219 |
| 4,288,724 | 9/1981 | Sherman | 315/219 |
| 4,320,325 | 3/1982 | Anderson | 315/205 |
| 4,362,970 | 12/1982 | Grady | 315/159 |
| 4,376,912 | 3/1983 | Jernakoff | 315/248 |
| 4,388,566 | 6/1983 | Bedard et al. | 315/291 |
| 4,392,081 | 7/1983 | Brown et al. | 315/46 |
| 4,415,838 | 11/1983 | Houkes | 315/248 |
| 4,472,661 | 9/1984 | Culver | 315/276 |
| 4,496,880 | 1/1985 | Lück | 315/228 |
| 4,508,996 | 4/1985 | Clegg et al. | 315/224 |
| 4,667,133 | 5/1987 | Nilssen | 315/324 X |
| 4,904,904 | 2/1990 | Zarate | 315/219 |

*Primary Examiner*—Eugene R. LaRoche
*Assistant Examiner*—Ali Neyzari
*Attorney, Agent, or Firm*—Edward E. Roberts

[57] ABSTRACT

A circuit, including an electrical load such as a fluorescent lamp, energized through an inverter which is in turn energized from a standard household alternating current voltage source. The output of the inverter is of a low voltage, low current and high frequency. This power is then transmitted by a low current voltage link, in the form of a flexible small gauge, jacketed wire conductor connected across the outputs of the inverter, to the input terminals of a compact step-up transformer located a distance away from the inverter. The power created by the step-up transformer is converted to usable power by the electrical load. The low voltage link need not be enclosed in a raceway.

21 Claims, 3 Drawing Sheets

REMOTE ELECTRICAL CONVERTER

BACKGROUND OF THE INVENTION

The background of the invention will be discussed in two parts.

FIELD OF THE INVENTION

This invention relates to electrical conversion apparatus, and more particularly, to an apparatus for converting conventional household electrical power to a high frequency, low current and low voltage potential which can then be transmitted via a small gauge current carrying conductor to a step-up transformer, and suitable electrical load, located a distance away.

DESCRIPTION OF THE PRIOR ART

Power supplies driven by conventional alternating electrical current have been used for decades. Two of the most common power supplies are the autotransformer, or ballast, and the conventional transformer. Both are used to supply power to many different type of electrical devices. Electric motors, and incandescent, mercury vapor, neon and fluorescent lamps, are among the most common uses for such power supplies. However, due to the high voltage potential characteristics of transformer secondary windings, National Electrical Codes (N.E.C.) require that connections made to such windings leading to an electrical device must be enclosed in a protective raceway. These raceways can be not only expensive, but troublesome to install, and unsightly as well.

One such fluorescent lamp circuit is shown and described in U.S. Pat. No. 3,671,803, entitled "Portable Self-Starting Fluorescent Lamp", issued to Hoxsie on June 20, 1972. The circuit includes a saturating type switching transformer with an inductance connected in the primary which is connected in circuit with an inverter and a capacitor to provide the starting voltage.

U.S. Pat. No. 3,778,677, entitled "Inverter Ballast Circuit", issued to Kriege on Dec. 11, 1973. This patent shows a circuit, in which a battery power source is connected through an inverter to one of several primary windings of a transformer, with plural secondary windings. An additional secondary winding raises both filaments of the fluorescent lamp to a high voltage above the battery ground.

A protection circuit is shown for use in a battery operated fluorescent lamp emergency lighting system in U.S. Pat. No. 4,096,410, entitled "Inverter Circuit Protection", which issued to Alley on June 20, 1978.

A circuit for use with gaseous discharge lamps is shown and described in U.S. Pat. No. 4,288,724, entitled "Impulse Generator for use With Phosphor Energizable Lamps", issued to Sherman on Sept. 8, 1981. The circuit emits a series of pulses to energize the lamps. A second Sherman U.S. Pat. No. 4,129,805, which issued Dec. 12, 1978 is the parent of the earlier issued patent.

U.S. Pat. No. 4,320,325, entitled "Circuit for Starting and Ballasting Arc Discharge Lamps", issued to Anderson on Mar. 16, 1982. This patent discloses a circuit which utilizes a filament connected in series with the arc lamp to provide illumination during start-up, and which functions as a ballast during normal arc operation.

A photoelectric cell controlled circuit is shown and described in U.S. Pat. No. 4,362,970, entitled "Energy Conserving Electrical Power Control circuit", which issued to Grady on Dec. 7, 1982.

U.S. Pat. No. 4,376,912, entitled "Electrodeless Lamp Operating Circuit and Method", issued to Jernakoff on Mar. 15, 1983, and discloses a circuit using a magnetic core operated at radio frequencies.

U.S. Pat. No. 4,388,566, entitled "Passive Control Network for Remote Control of Load Output Level", issued to Bedard et al on June 14, 1983, and discloses a circuit for passive control of a load impedance from a remote location.

U.S. Pat. No. 4,392,081, entitled "Lighting Unit", issued to Brown et al on July 5, 1983, and discloses a circuit built into an arc lamp unit.

Another such built in circuit is shown and describe in U.S. Pat. No. 4,415,838, entitled "Frequency Converter for Supplying an Electrodeless Discharge Lamp", which patent issued on Nov. 15, 1983 to Houkes.

Another lamp driver circuit is disclosed in U.S. Pat. No. 4,472,661, entitled "High Voltage, Low Power Transformer for Efficiently Firing a Gas Discharge Luminous Display", which issued to Culver on Sept. 18, 1984.

A fluorescent lamp driver circuit is disclosed in U.S. Pat. No. 4,496,880, entitled "Fluorescent Lamp Ballast", which issued to Luck on Jan. 29, 1985.

The above patents are representative of the state of the art in circuits for driving fluorescent lamps, gas discharge lamps and arc lamps.

In accordance with an aspect of the invention, it is accordingly an object of the invention to provide a new and improved method and apparatus for energizing fluorescent lamps.

SUMMARY OF THE INVENTION

The foregoing and other objects of the invention are accomplished by providing circuits, including either one or two fluorescent lamps, energized through an inverter which is in turn energized from a standard household alternating current voltage source. The inverter output power is of low voltage, low current and high frequency. This inverter output power is then transmitted by a low voltage link in the form of a flexible small gauge, jacketed dual-wire conductor connected across the outputs of the inverter. This low voltage conductor link is then electrically connected to the input terminals of a compact step-up transformer, which transformer is located a desired distance away from the inverter. The power created by the step-up transformer is converted to usable power at the output terminals by connection to a suitable device, such as a lamp.

The high frequency conversion used in conjunction with ferromagnetic materials, such as ferrite pot cores, make it possible to utilize small size step-up and step-down transformers to thus provide compactness to the invention at both the inverter end and at the step-up transformer located at termination of the low voltage link.

At the inverter, conventional 110 volt alternating electrical current is connected across a diode rectifying bridge which then generates a high D.C. voltage necessary for inverter operation. The inverter steps the voltage and current down to a level low enough for transmission through a small gauge conductor. This conductor is then connected across a pair of output terminals located on the inverter for the purpose of providing the output of the inverter to the primary of a step-up transformer, which is located some distance away from the inverter. The secondary of the step-up transformer is then connected to the fluorescent light source, or other electrical load. The low voltage link need not be enclosed in a raceway.

Other objects, features and advantages of the invention will become readily apparent from a reading of the specification, when taken in conjunction with the drawings, in which like reference numerals refer to like elements in the several views.

DESCRIPTION OF THE PREFERRED EMBODIMENT

Since, in accordance with the National Electrical Code, high voltage conductors are required to be enclosed within a raceway, this invention eliminates the need for raceways by reducing the voltage and current to levels acceptable to the National Electrical Code for low voltage line transmission. For this invention, a flexible small gauge, jacket wire conductor can be connected between the power source and the distant conversion apparatus at the lamp or other terminal electrical load.

Figure 1:
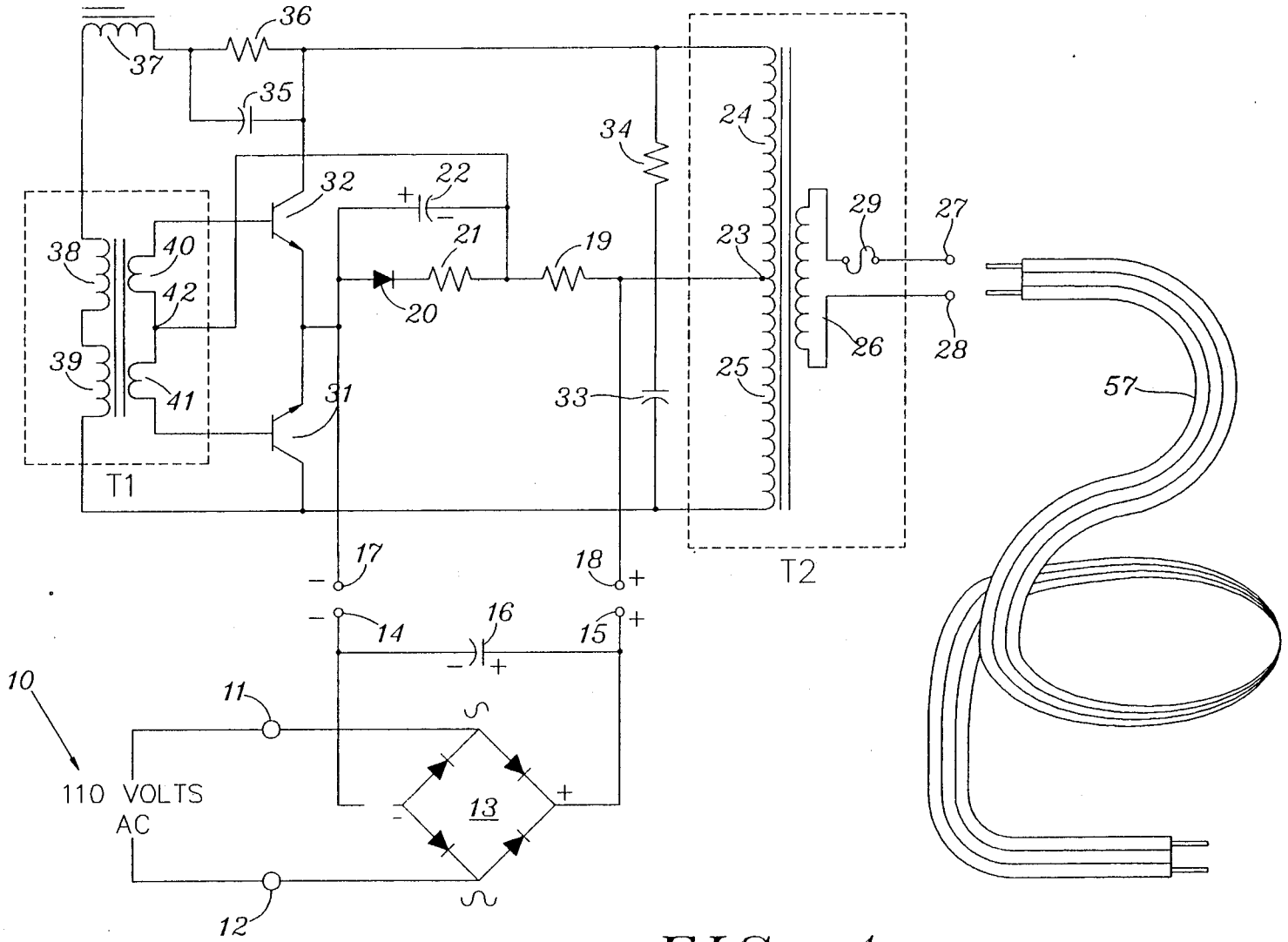
FIG. 1 is a schematic diagram of the power source utilized to convert conventional household electrical power to a high frequency low voltage power in accordance with the invention.

Referring now to the drawings, and particularly FIG. 1, there is shown a power source means which, as will be described, converts conventional household alternating current energy to a low voltage, low current, high frequency power. This source means includes a rectifying bridge 13, a step-down transformer T2, a feedback transformer T1, and a switching transistor arrangement. In accordance therewith, a conventional alternating current electrical source 10, as for example 110 volts 60 cycle, is connected across input terminals 11 and 12 of a conventional diode bridge 13, the output of which is designated by the polarity designated terminals 14 and 15.

Connected across diode bridge 13 output terminals 14 and 15 is filter capacitor 16, which acts to reduce the ripple voltage at terminals 14 and 15 to a desired value for inverter operation, terminals 14 and 15 being connected to the inverter input terminals 17 and 18, having polarities as shown.

Terminals 17 and 18 are shunted by a diode 20 in series with first and second resistors 21 and 19. The diode 20, resistor 21 combination is in parallel with a capacitor 22, one end of which is connected at a point intermediate resistors 21 and 19. A voltage divider is thus created by utilizing this connection, along with inverter input terminals 17 and 18, to provide the starting current for the inverter. The series combination of diode 20 and resistor 21, along with the use of a large ohmic value for resistor 19, causes the D.C. supply of diode 13 to see a low resistance path to the base of each transistor 31 and 32, to produce an increase of the current gain parameter of each transistor to the point where high frequency oscillation begins. A low impedance path for the combined base current of the transistors is formed by capacitor 22 in parallel with the series connected diode 20 and resistor 21. The high frequency voltage across windings 40 and 41 in transformer T1 forward biases diode 20 which allows base current to flow for alternate half cycles in the bases of transistors 31 and 32.

The inverter's positive input terminal 18 is connected to the center tap 23 of the primary windings 24 and 25 of a first, or step down, ferrite pot core transformer T2. These and the other ferrite pot cores herein described exhibit square loop characteristics. These two primary windings 24, 25 are inductively coupled to the secondary winding 26, which provides power at output terminals 27 and 28 with a maximum current limiting fuse 29 in series therewith. In accordance with the invention, to provide a step down of the household current, the ratio of voltage reduction from the primary windings 24 and 25 to the secondary winding 26 is on the order of 5:1, to yield a maximum voltage of 30 volts RMS (43 volts peak) for sinusoidal or quasi-sinusoidal waveforms at terminals 27 and 28, while maintaining a high frequency of approximately 24 kHz to 30 kHz, as will be described. These windings 24, 25 and 26 are all wound on the same ferrite pot core of the power source output transformer T2.

A network consisting of a capacitor 33 in series with a resistor 34 is connected across the outer ends of transformer T2 primary windings 24 and 25, with capacitor 33 reducing the high voltage spikes seen across the primary windings 24 and 25 while resistor 34 serves to limit the high frequency current pulses through capacitor 33 during the short intervals when the transistors switch from the "ON" to "OFF" state. Further, the outer ends of transformer T2 primary windings 24 and 25 are respectively connected to the collectors of switching transistors 32 and 31.

The emitters of switching transistors 31 and 32 are coupled together, and connected to the inverter's negative input terminal 17. Connected in series across the collectors of transistors 31, 32, is an RC network consisting of a capacitor 35 in parallel with a resistor 36, an inductor 27 on the order of 0.8 mH, and the series connected primary windings 38, 39, of feedback transformer T1. With this RC arrangement, a speed-up is caused in the circuit which enhances the switching speed of the inverter, that is to say, that the turn-on and turn-off times are shortened. The function of inductor 37 is to reduce the effects of transistor storage time by supporting the feedback voltage when transformer T1 begins to saturate.

Feedback transformer T1 consists of primary windings 38, 39 which are inductively coupled, respectively, to series connected secondary windings 40, 41. The center tap 42 of secondary windings 40, 41 is connected to the center tap of the voltage divider (the common node of resistors 21, 19), with the outer ends of these secondary windings 40, 41 connected, respectively, to the base of transistors 31 and 32.

The winding ratio between each primary and its corresponding secondary of the feedback transformer T1 is approximately 40:1, with the feedback transformer T1, in conjunction with switching transistors 31 and 32, providing the inverter switching action. With the output transformer T2 constructed as described above, this switching yields a maximum voltage of 30 volts RMS or 43 volts peak at secondary terminals 27 and 28 while maintaining a frequency of approximately 24 Khz-30

Khz, at the output terminals 27, 28, with a maximum current output of 3.0 amperes.

By combining this feedback transformer T1 and the output transformer T2 with a switching circuit in the manner described, a step-down inverter is created and becomes the power source for the first part of this invention. In essence, the transistors 31 and 32 are operating in push-pull configuration to generate an alternating trapezoidal voltage waveform across the primaries 24, 25 of transformer T2, with a half cycle of one polarity being transmitted via winding 24 and a half cycle of the opposite polarity being transmitted via winding 25.

The transistors 31, 32 are base controlled by means of the couplings thereof to the secondary windings 41, 40, respectively, of the feedback transformer T1. With the effect of inductor 37 resulting in low saturating currents through the primary windings 38, 39, and the 40:1 ratio with the secondary windings, a low width-modulated controlled current is applied to the bases of the transistors 31, 32 to effect the switching. The output of this power source is then transmitted over a low voltage link 57, which as previously described, is a flexible small gauge, jacket wire conductor connected across the outputs 27, 28, of the inverter.

Figure 2:
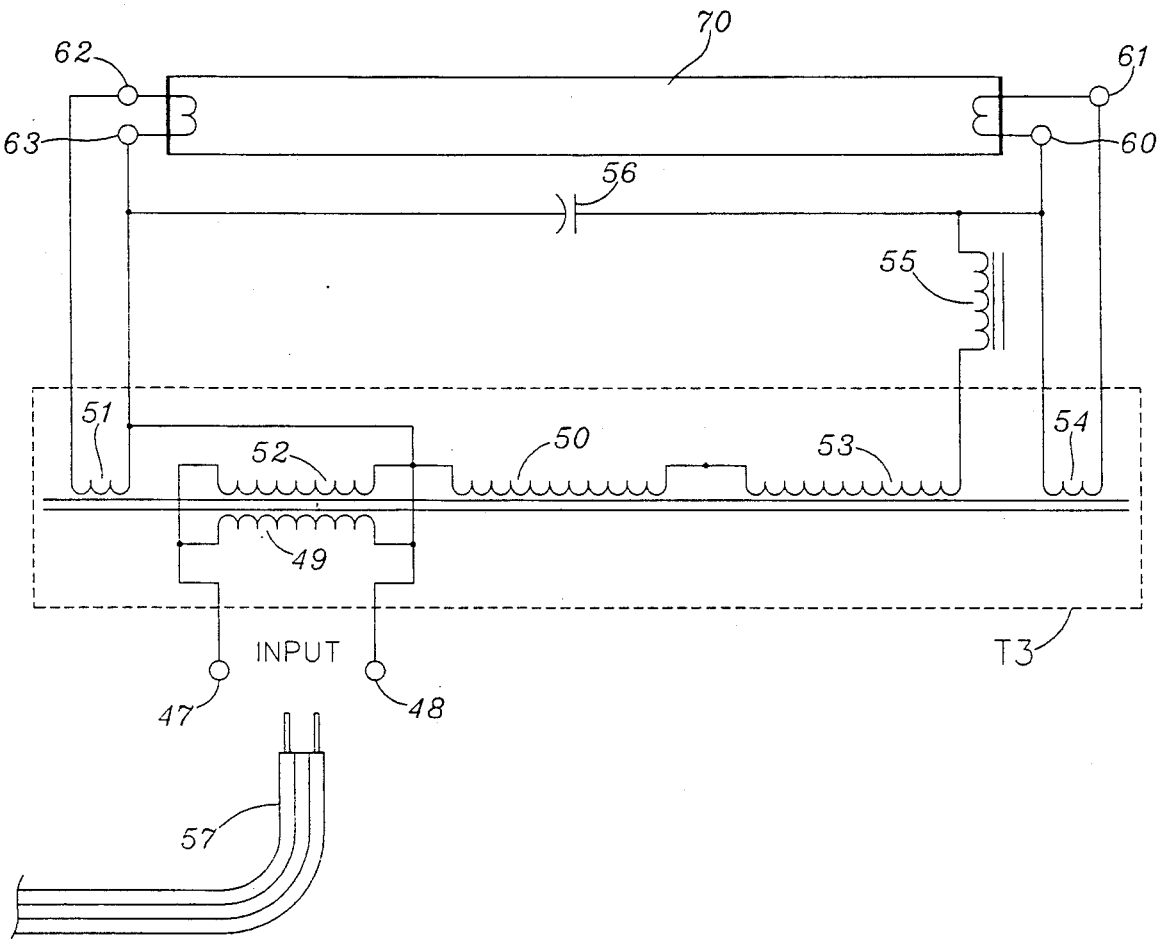
FIG. 2 is a schematic diagram of conversion apparatus and a single fluorescent lamp configuration utilized in accordance with the invention.

Referring now to the single lamp configuration of FIG. 2, the low voltage, low current, high frequency output power transmitted over the low voltage link 57 appears at input terminals 47, 48 of the low voltage power conversion apparatus, which includes a step-up transformer T3.

In the embodiment shown, this transformer T3 consists of two (2) transformers which are joined electrically to make the step-up transformer T3. The use of two transformers functioning as a single transformer allows a geometry compatible with fluorescent lamp cross-section. One transformer includes primary winding 49 connected to input terminals 47 and 48, secondary winding 50, and a tertiary or filament winding 51. The other transformer includes primary winding 52, secondary winding 53, and a tertiary or filament winding 54.

To provide an electrically coupled unit, the primary windings 49 and 52 are connected in parallel with each other for the purpose of creating a symmetrical current waveform across a fluorescent lamp. The secondary windings 50 and 53 are connected in series with the paralleled primary windings 49 and 52.

Each transformer consists of a primary, secondary and filament windings wound around a pair of ferrite pot cores. For instance, primary 49 and secondary winding 50 are wound around a single pair of ferrite pot cores to form one-half of the step-up lamp transformer T3. Likewise, primary 52 and secondary winding 53 are wound around a second single pair of ferrite pot cores to form the other half of the step-up lamp transformer T3. Each of these transformers is generally identically configured. These two cores are then joined electrically to make the step-up lamp transformer T3.

The winding ratio between the primary and secondary of each of these transformers is sufficient to step up the voltage to a level high enough for operation of the lamp 70. This special primary/secondary winding scheme first provides power to ignite the lamp 70, and secondly, after the high voltage ignition is complete, the transformer T3 adjusts to a smaller steady state voltage. In addition, the leakage inductance plus the inductance of the inductor 55 limits the current flow to the lamp 70.

The filament winding 51 of the first transformer is connected across the terminals 62, 63 of the filament of the lamp 70. Similarly, the filament winding 54 of the second transformer is connected across the terminals 60, 61 of the other filament of the lamp 70. A capacitor 56 is connected between the terminals 60, 63 of the filaments, while a ferrite core inductor 55 has one end of the winding thereof connected to the filament terminal 60 and the other end connected in series with the series connected secondary windings 50, 53 of transformer T3. To complete the circuit interconnection, the input terminal 48 is connected to the filament terminal 63.

Inductor 55 is thus electrically in series with the secondary windings 50 and 53 and, as to lamp terminal 63, in series with the capacitor 56. The series arrangement of the inductor 55 and capacitor 56 combine to form a series resonant circuit. The proper selection of values of capacitance and inductance for the capacitor 56 and inductor 55 provides the high starting voltage required for lamp ignition. Inductor 55 and capacitor 56 also tend to stabilize lamp current by virtue of their effect on the inverter frequency as lamp ignition/steady state characteristics change. In the embodiment shown the values are typically on the order of 5.6 mH for the inductor 55 and 680 pF for the capacitor 56.

Windings 51 and 54 are filament windings as specified by the manufacturer of the lamp 70. In this embodiment, the tapped voltages from each of these filament windings 51, 54 is set approximately 2.8–3.4 Volts RMS. The purpose of these filament windings 51, 54 is to maintain a voltage across each of the lamp filament terminals 60, 61 and 62, 63 sufficient to insure proper operation during both the ignition and steady state modes. These lamp filaments are connected across their respective transformer filament secondary windings 51, 54 and are an integral part of the circuit.

In operation of the invention, the conventional alternating current is rectified, and switched or inverted via transistors 31, 32 and feedback transformer T1, for application to the primary of the step-down transformer T2 to provide a low voltage, low current, high frequency power source at terminals 27, 28. This power source is then transmitted any reasonable distance from the power source by the low voltage link 57, which is a flexible small gauge, jacketed wire conductor, which does not require being enclosed in a raceway and may be readily concealed or disguised.

At the lamp end, this low voltage high frequency energy is converted, via step-up transformer T3, including two generally identical transformers having the primary windings 49 and 52 connected in parallel with each other for the purpose of creating a symmetrical current waveform across the lamp. The secondary windings 50 and 53 are connected in series with the paralleled primary windings 49 and 52. This special primary/secondary winding scheme first provides power to ignite the lamp 70, and secondly, after the high voltage ignition is complete, the transformer T3, in conjunction with the inductor 55, maintains a proper level of lamp power.

By use of the ferrite pot cores, the step down transformer T2 and step-up transformer T3 can be constructed as compact units. Thus, the primary advantages of the invention resides in the use of a compact step-down transformer connected to the conventional AC source, with the output connected to a low voltage link providing power to a step-up transformer located a distance away from the inverter. By combining high frequency with low voltage, a small gauge, low current carrying conductor can be strung to an electrical device without the necessity of enclosing it in a raceway, to both greatly simplify the installation of the electrical device, while enabling ease of concealment by the use of the low voltage link 57. This link's flexibility and thinness of gauge makes it possible to disguise or hide this conductor quite easily.

Figure 3:
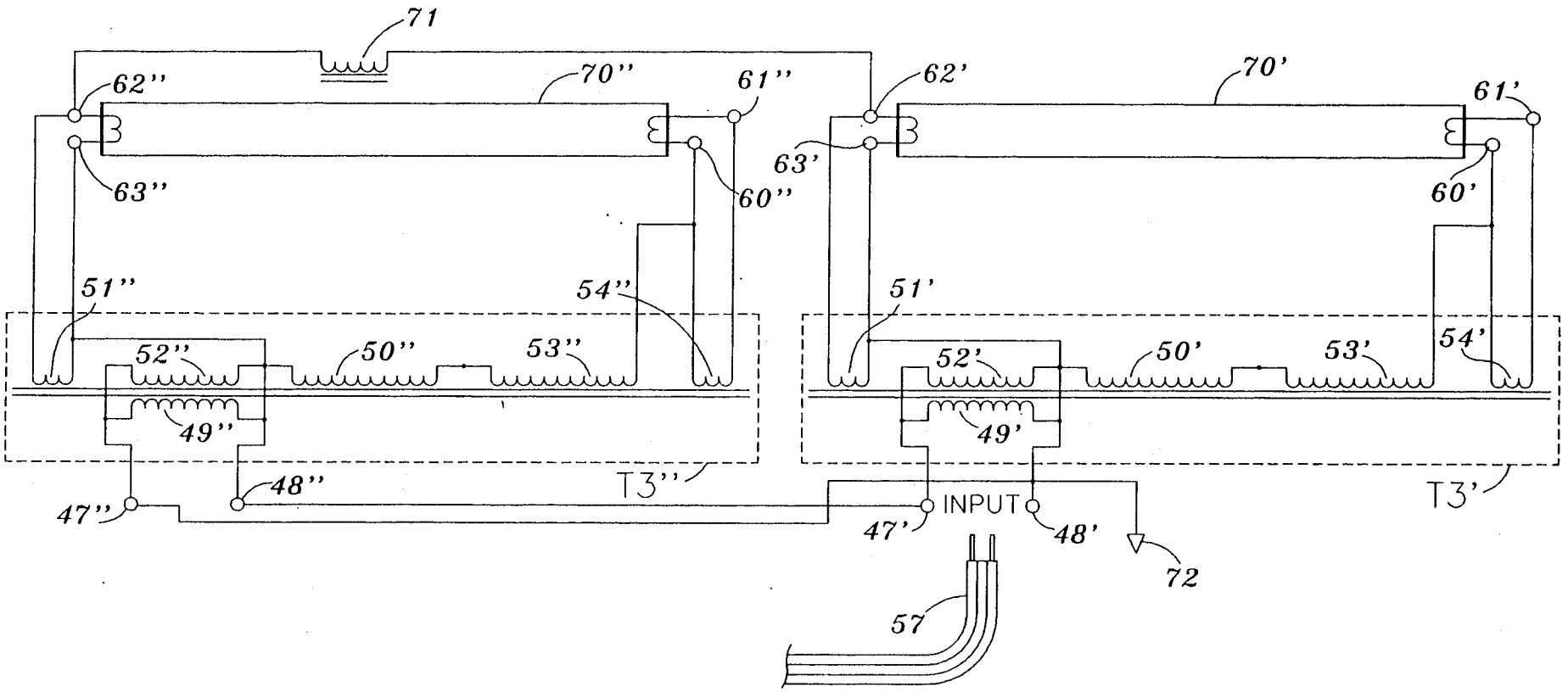
FIG. 3 is a schematic diagram of conversion apparatus and a double fluorescent lamp configuration utilized in accordance with the invention.

Referring now to the two lamp configuration of FIG. 3, the two lamp configuration is shown comprised of lamps 70' and 70" connected in series, each of the series connected lamp configurations having, except for the addition of inductor 71, and the deletion in each instance of capacitor 56 and inductor 55, essentially the same circuitry as the lamp configuration of FIG. 2. As shown, inductor 71 is connected between terminals 62' of lamp 70' and terminal 62" of lamp 70". With the deletion of inductor 55, the filament terminals 60', 60" are respectively connected directly in series with the series connected secondary windings 50', 53' and 50", 53", of transformers T3' and T3", respectively. Transformer T3' input terminals 47', 48' are connected respectively to transformer T3" input terminals 48", 47", and terminal 48' further connected to earth ground 72.

While there has been shown and described a preferred embodiment in particular relation to the circuit illustrated herein, it is to be understood that other and further modifications, variations and other uses and applications may be made which do not depart from the spirit and scope of the invention which is limited only by the following claims.

What is claimed is:

1. Electrical power conversion apparatus for energizing an electrical device, such as a fluorescent lamp, from a conventional alternating current source, said apparatus comprising:

power source means for converting the conventional alternating current to a low voltage, low current, high frequency source, said power source means includes means for rectifying the conventional alternating current, inverter means connected to the output of said rectifying means for producing high frequency alternating current, and step-down transformer means for converting said high frequency alternating current to a low voltage, low current, high frequency output at the output of said step-down transformer means;

device means remote from said power source means;

power conversion means including step-up transformer means electrically coupled to said device means;

low voltage link means connected to the output of said power source means for transmitting the energy therefrom to the input of said power conversion means for enabling conversion of said low voltage, low current, high frequency source to a voltage suitable for energizing said electrical device; and said step-up transformer means includes first and second generally identical ferrite pot core transformers having the primary windings thereof connected in parallel for providing a symmetrical current waveform to said device means.

2. The apparatus according to claim 1 wherein the output of said power source means is limited to a maximum of approximately 30 volts RMS or 43 volts at a frequency of approximately 24–30 Khz, and the output current of said power source means is limited to a maximum of 3 amperes.

3. The apparatus according to claim 1 wherein the output voltage of said power source means is electrically limited to 30 volts RMS or 43 volts peak, and said power conversion means provides power to said device means at operating voltages much greater than 30 volts RMS.

4. The apparatus to claim 1 wherein said first and second ferrite pot core transformers each have a secondary winding and a tertiary winding.

5. The apparatus according to claim 4 wherein said device means is at least one fluorescent lamp including first and second filaments, each of which is connected to a tertiary winding.

6. The apparatus according to claim 5 wherein said parallel connected primary windings form a series circuit with the secondary windings of said first and second transformers and with an inductor.

7. The apparatus according to claim 6 wherein said series circuit is connected in parallel with a capacitor across said device means, the value of the capacitor and the value of the inductor being selected to establish a generally resonant circuit for assisting in establishing and maintaining the discharge within said fluorescent lamp.

8. Electrical power apparatus for energizing a fluorescent lamp, said apparatus comprising;

means for providing a low voltage, low current, high frequency source at an output;

power conversion means electrically coupled to the fluorescent lamp, said power conversion means having an input and including step up transformer means having first and second primary windings, first and second secondary windings and first and second tertiary windings, the first and second tertiary windings being coupled to the filaments of the lamp, wherein said primary windings are connected in parallel and form a series circuit including both of said secondary windings in series with an inductor, with the series circuit so-formed connected in parallel with a capacitor across said lamp, the value of the capacitor and inductor being selected to establish a resonant circuit;

low voltage link means connected to said output for transmitting the high frequency, low current, low voltage to the input of said power conversion means for enabling conversion of the high frequency low voltage to a voltage suitable for energizing said lamp, said resonant circuit assisting to establish and maintain the gaseous discharge within said fluorescent lamp; and wherein said means for providing a low voltage, low current, high frequency includes means coupled to a conventional alternating current source, means for rectifying the conventional alternating current, inverter means for converting the rectified output to a high frequency alternating current and step-down transformer means for providing a high frequency, low current, low voltage at said output.

9. The apparatus according to claim 8 wherein said inverter means includes first and second semiconductor means connected in push pull configuration and control thereof is effected through feedback transformer means sensing current through said semiconductor means.

10. The apparatus according to claim 9 wherein said feedback transformer means includes inductor means in series with the primary thereof for controlling saturation current to the feedback transformer means.

11. The apparatus according to claim 9 wherein said semiconductor means are transistors and said inverter means includes step-down transformer means, the output of which is high frequency, low current and low voltage.

12. The apparatus according to claim 11 wherein said conventional alternating current source is about 110 to 120 volts and the output or said inverter is limited to a maximum of approximately 30 volts RMS or 43 volts peak at a frequency of approximately 24–30 Khz.

13. The apparatus according to claim 8 wherein the output current of said inverter is limited to a maximum of 3 amperes.

14. The apparatus according to claim 13 wherein the output voltage of said inverter is electrically limited to 30 volts RMS or 43 volts peak.

15. Electrical power apparatus for energizing a two fluorescent lamp configuration, said apparatus comprising;

means for providing a low voltage, low current, high frequency source at an output;

first and second power conversion means electrically coupled respectively to one of said fluorescent lamps, each of said power conversion means having an input and including step-up transformer means having first and second primary windings, first and second secondary windings and first and second tertiary windings, the first and second tertiary windings being coupled to the respective lamp filaments, wherein said primary windings are connected in parallel and form a series circuit including both of said secondary windings, with the series circuit so-formed connected in parallel across the lamp;

an inductor connecting a selected filament terminal of one of said lamps to a selected filament terminal of the other of said lamps, said inductor assisting to establish and maintain the gaseous discharge within each of said fluorescent lamps;

low voltage link means connected to said output for transmitting the high frequency, low current, low voltage to the input of said first power conversion means;

connective means for interconnecting the inputs of said first and second power conversion means for enabling conversion of the low current, low voltage, high frequency source to a voltage suitable for energizing said lamps; and wherein said means for providing a high frequency, low current, low voltage includes means coupled to a conventional alternating current source, means for rectifying the conventional alternating current, inverter means for converting the rectified output to a high frequency alternating current and step-down transformer means for providing a high frequency, low current, low voltage at said output.

16. The apparatus according to claim 15 wherein said connective means includes an earth ground, and said low voltage, low current, high frequency source is electrically limited to approximately 30 volts RMS or 43 volts peak at a frequency of approximately 24–30 Khz, and the output current is limited to a maximum of 3 amperes.

17. The apparatus according to claim 16 wherein said inverter means includes first and second semiconductor means connected in push pull configuration with control thereof effected through feedback transformer means sensing current through said semiconductor means, and wherein said feedback transformer means includes inductor means in series with the primary thereof for controlling saturation current to the feedback transformer means.

18. Electrical power conversion apparatus for energizing a remote electrical device from a conventional alternating current source, said apparatus comprising:

power source means including a diode rectifying bridge, a feed-back transformer, a step-down transformer, and push-pull transistor switching means for converting the conventional alternating current to a low voltage, low current, high frequency power source;

electrical device means remote from said power source means;

power conversion means having input terminals and including at least one step-up transformer and mating circuitry electrically coupled to said device means enabling conversion of the low voltage, low current, high frequency source to provide suitable ignition and steady state operating power to said device means;

low voltage link means connected between said output terminals and said input terminals for transmitting the energy from said power source means to the said conversion means; and wherein said step-up transformer further includes two substantially identical transformers each having a primary, secondary, and tertiary winding, the primary windings being connected in parallel and forming a series circuit with the secondary windings.

19. The apparatus according to claim 18 wherein said device means is a fluorescent lamp including first and second filaments, each connected to a said tertiary winding, and said mating circuitry includes inductor and capacitance means for establishing a generally resonant circuit for assisting and maintaining the discharge within said at least one fluorescent lamp.

20. The apparatus according to claim 18 wherein:

said device means includes two fluorescent lamps;

said power conversion means includes first and second step-up transformers electrically coupled respectively to one of said fluorescent lamps, each of said step-up transformers having first and second primary windings, first and second secondary windings and first and second tertiary windings, the first and second tertiary windings being coupled to the respective lamp filaments, wherein said primary windings are connected in parallel and form a series circuit including both of said secondary windings, with the series circuit so-formed connected in parallel across the lamp;

said mating circuitry includes an inductor connecting a selected filament terminal of one of said lamps to a selected filament terminal of the other of said lamps, said inductor assisting to establish and maintain the gaseous discharge within each of said fluorescent lamps; and wherein there is included connective means for interconnecting the inputs of said first and second step-up transformers for enabling conversion of the low current, low voltage, high frequency source to a voltage suitable for energizing said lamps.

21. The apparatus according to claim 18 wherein said conventional alternating current source is substantially 115 volts, the output or said power source means is limited to a maximum of approximately 30 volts RMS or 43 volts at a frequency of approximately 24–30 Khz, the output current of said power source means is limited to a maximum of 3 amperes, and said power conversion means provides power to said device means at operating voltages much greater than 30 volts RMS.

* * * * *